US005562786A

United States Patent [19]

Hayashi et al.

[11] Patent Number: 5,562,786

[45] Date of Patent: Oct. 8, 1996

[54] PROCESS FOR PRODUCING HEAT-TREATED SINTERED IRON ALLOY PART

[75] Inventors: Tetsuya Hayashi; Yoshinobu Takeda, both of Hyogo, Japan

[73] Assignee: Sumitomo Electric Industries, Ltd., Osaka, Japan

[21] Appl. No.: 374,123

[22] Filed: Jan. 18, 1995

[51] Int. Cl.$^6$ ..... C21D 6/00

[52] U.S. Cl. ..... 148/579

[58] Field of Search ..... 148/514

[56] References Cited

U.S. PATENT DOCUMENTS

| | | | |
|---|---|---|---|
| 3,951,697 | 3/1976 | Sherby et al. . | |
| 4,251,273 | 2/1981 | Smith et al. | 419/28 |
| 4,778,522 | 10/1988 | Maki et al. | 75/238 |
| 4,796,575 | 1/1989 | Matsubara et al. | 75/230 |

OTHER PUBLICATIONS

Patent Abstracts of Japan vol. 005 No. 025 (M–055), 14 Feb. 1981.

Derwent Publications Ltd., London, GB; Class M22, AN 88–267713.

*Primary Examiner*—Deborah Yee

*Attorney, Agent, or Firm*—Sughrue, Mion, Zinn, Macpeak & Seas

[57] ABSTRACT

A process for producing a heat-treated sintered iron alloy part, the process comprising: austenizing an iron-based sinter having a martensitic transformation initiation point (Ms point) of from 50° to 350° C., at a temperature not lower than the austenizing temperature (Ae1 point) of the sinter; quenching the austenized sinter at a cooling rate at which martensitic transformation occurs; and sizing or coining the quenched sinter at the time when the temperature of the sinter which is being quenched has reached the temperature range of from the Ms point to the Ae1 point.

8 Claims, No Drawings

PROCESS FOR PRODUCING HEAT-TREATED SINTERED IRON ALLOY PART

FIELD OF THE INVENTION

The present invention relates to a process for producing a heat-treated sintered iron alloy part having enhanced strength and hardness and, in particular, excellent dimensional accuracy, by heat-treating an iron-based sinter obtained by powder metallurgy.

BACKGROUND OF THE INVENTION

Sintered iron alloys obtained by powder metallurgy have advantages, for example, that compositions difficult to produce by melt casting can be obtained and mechanical parts having a near-net shape can be produced without cutting, etc. Hence, sintered iron alloys are recently coming to be used as mechanical parts in various fields in place of conventional cast iron alloys.

In the case where higher strength and hardness are desired, sintered iron alloys can be subjected to heat treatments such as quenching and tempering. The heat-treated sintered iron alloys having enhanced strength and hardness through such a heat-treatment are used, e.g., as automotive parts such as oil pump rotors and gears for engines.

With the recent needs for weight reduction and performance increase in motor vehicles and industrial machines, these heat-treated sintered iron alloy parts are increasingly required to have even higher strength and dimensional accuracy. However, since heat-treated sintered iron alloys have undergone martensitic transformation and hence have high deformation resistance and low deformability, dimensional correction thereof by sizing or coining is very difficult. Thus, it is extremely difficult to attain a further improvement in dimensional accuracy.

In particular, if heat-treated sintered iron alloys have a surface hardness of 60 or higher in terms of $H_RA$ or a tensile strength of 80 kg/mm$^2$ or higher, since sizing or coining thereof needs a pressure as high as above 10 t/cm$^2$, an increased load is imposed on the mold to shorten the life of the mold. Moreover, parts obtained from these iron alloys through dimensional correction are limited in shape. Furthermore, the attainable improvement in dimensional accuracy is less than in ordinary sintered iron alloys because of the influence of mold deflection, etc.

Hitherto, heat-treated sintered iron alloy parts required to have high strength and high hardness have been produced by a process comprising sizing or coining an iron-based sinter, heat-treating the sinter, and then subjecting the heat-treated sinter to machining, e.g., cutting, to dimensionally correct the portion thereof that is required to have higher dimensional accuracy. Thus, desired dimensional accuracy has been attained. Examples of the heat-treated sintered iron alloy parts produced by this prior art process include oil pump rotors and gears for automotive engines.

However, the conventional process described above has a drawback that the parts obtained have considerably impaired dimensional accuracy because the residual stress resulting from the sizing or coining of the iron-based sinter is released during the subsequent heat treatment. Namely, the sizing or coining which takes advantage of the presence of pores is not effective. In the case of oil pumps, for example, the impaired dimensional accuracy causes problems of a decrease in pump efficiency, increased noise, etc.

Another drawback of the prior art process is that it not only has an increased processing cost due to the necessity of machining, e.g., cutting, besides sizing or coining, but also has an increased material cost due to a material loss from processing. As a result, the parts produced by the prior art process are not competitive in price with parts obtained from general steel materials through machining, or with iron alloy parts obtained by heat-treating a cold or hot forging and machining the heat-treated forging.

SUMMARY OF THE INVENTION

An object of the present invention is to provide a process for economically and cost-effectively producing a heat-treated sintered iron alloy part having high strength, high hardness, and excellent dimensional accuracy without performing any machining operation such as cutting.

Other objects and effects of the present invention will be apparent from the following description.

The present invention relates to a process for producing a heat-treated sintered iron alloy part, the process comprising:

austenizing an iron-based sinter having a martensitic transformation initiation point (Ms point) of from 50° to 350° C. at a temperature not lower than the austenizing temperature (Ae1 point) of the sinter;

quenching the austenized sinter at a cooling rate at which martensitic transformation occurs; and sizing or coining the quenched sinter at the time when the temperature of the sinter which is being quenched has reached the temperature range of from the Ms point to the Ae1 point.

DETAILED DESCRIPTION OF THE INVENTION

In the present invention, dimensional correction by sizing or coining is conducted simultaneously with heat treatment in a heat treatment step as the final step in order to obtain high dimensional accuracy. When an iron-based sinter is quenched and the temperature thereof is still above the martensitic transformation point (Ms point) thereof, the sinter is in the austenite region where the crystalline structure of the iron is the fcc structure having a high content of carbon in solid solution. In this stage of cooling, the sinter being quenched hence has low deformation resistance and high deformability. Therefore, by sizing or coining the quenched sinter to cause plastic deformation to thereby crush pores, a heat-treated sintered iron alloy part having an increased density and high dimensional accuracy can be obtained.

That is, when a sinter is sized or coined at a temperature not higher than the Ae1 point thereof and not lower than the Ms point thereof, the sinter is cooled to a temperature around the mold temperature and the Ms point rises due to the pressure applied for sizing or coining to thereby induce martensitic transformation. As a result, a higher strength and a higher hardness are attained due to martensitic transformation and, at the same time, dimensional correction is accomplished by sizing or coining. Furthermore, since the sized or coined sinter is taken out of the mold after completion of martensitic transformation, a heat-treated sintered iron alloy part having dimensions equal to those of the mold cavity can be obtained.

If the temperature of the sinter to be sized or coined has decreased to below its Ms point before the initiation of sizing or coining, martensitic transformation begins to increase deformation resistance. As a result, it becomes difficult to perform dimensional correction by crushing pores of the sinter. Furthermore, if the temperature of the sinter to be sized or coined is still above its austenizing temperature (Ae1 point) at the time of the initiation of sizing or coining, it is difficult to attain both of dimensional correction and the enhancement of strength and hardness, because such conditions often result in incomplete martensitic transformation at the time of the completion of sizing or coining.

In order that an iron-based sinter whose temperature is in the range of from the Ms point to Ae1 point thereof be sized or coined to enhance its strength through martensitic transformation according to the process of the present invention, the sinter should begin to undergo martensitic transformation within the temperature range of from 50° to 350° C. If the Ms point of the iron-based sinter is lower than 50° C., there may be cases where the martensitic transformation is not completed during sizing or coining and proceeds after the sinter is taken out of the mold. If the Ms point of the sinter exceeds 350° C., sufficient dimensional correction cannot be attained because martensitic transformation proceeds before the completion of dimensional correction by sizing or coining due to heat transfer to the mold.

Since the sizing or coining of a quenched iron-based sinter is performed in the austenite region in the process of the present invention, no difficulties are encountered in the sizing or coining operation. However, in view of the fact that the sizing or coining of iron-based sinters which, through martensitic transformation, come to have a tensile strength of 80 kg/mm$^2$ or higher and a surface hardness of 60 or higher in terms of $H_RA$ has been difficult in the conventional process in which sizing or coining is performed after martensitic transformation in heat treatment, the process of the present invention is particularly effective when applied to sinters which come to have such high tensile strengths and surface hardness.

Iron-based sinters produced by powder metallurgy generally contain pores, so that they can be sized or coined. If the porosity of a sinter is lower than 5%, the deformation necessary for dimensional correction influences the interior of the sintered part to not only cause an increased residual strain, but also result in higher deformation resistance. If the porosity of a sinter exceeds 20%, the mechanical properties of the sinter may be so poor that strength and other properties are not improved to a satisfactory level even when sizing or coining is performed together with heat treatment. Therefore, the porosity of the iron-based sinter is preferably from 5 to 20%.

The composition of the iron-based sinter is not particularly limited, and may be the compositions of a carbon steel or the compositions of an alloy steel. The sinter contains carbon as an essential element so that it undergoes martensitic transformation through heat treatment to increase the strength and hardness thereof. The content of carbon is preferably from 0.2 to 1.6% by weight, because carbon contents lower than 0.2% by weight tend not to produce the above effect and carbon contents higher than 1.6% by weight tend to result in reduced toughness of the final part. Accordingly, in the case where the iron-based sinter is composed of a carbon steel, it preferably has a composition consisting of from 0.2 to 1.6 wt % of carbon and the balance of iron.

In particular, in the case where the iron-based sinter is an alloy steel, it preferably has a composition consisting of from 0.2 to 1.6 wt % carbon, at least 80 wt % iron, and at least one alloying element selected from Mo in an amount up to 8 wt %, Ni in an amount up to 6 wt %, Mn, Cr, and Cu each in an amount up to 4 wt %, W and Co each in an amount up to 2 wt %, and Si, V, and Al each in an amount up to 1 wt %, with the value F(e) defined by the following equation being from 200 to 500:

$$F(e)=350\times C\ \%+40\times Mn\ \%+35\times V\ \%+20\times Cr\ \%+17\times Ni\ \%+11\times Si\ \%+10\times Cu\ \%+10\times Mo\ \%+5\times W\ \%-15\times Co\ \%-30\times Al\ \%$$

wherein C %, Mn %, V %, Cr %, Ni %, Si %, Cu %, Mo %, W %, Co %, and Al % represent the amounts of C, Mn, V, Cr, Ni, Si, Cu, Mo, W, Co, and Al respectively, in terms of weight percents.

The reason for the above-specified limitations on the contents of the alloying elements such as Mn is that if the contents of the alloying elements, which are added in order to improve mechanical properties, exceed the respective ranges specified above, plastic deformation by sizing or coining is inhibited. If the F(e) value is below 200, the final part tends to have impaired thermal stability and insufficient strength. If the F(e) value exceeds 500, deformation resistance in sizing or coining tends to be high, making dimensional correction difficult. If the iron content is lower than 80% by weight, homogeneous martensitic transformation tends to be difficult, so that high dimensional accuracy may not be obtained.

The process of the present invention is explained below in more detail. An iron-based sinter is firstly produced according to an ordinary procedure of powder metallurgy by mixing powders as starting materials, compacting the powder mixture, and sintering the compact. A partially diffused alloy powder in which alloying elements have been diffusion-bonded is preferably used as a component of the starting material, because use of the alloy powder results in reduced compositional fluctuations in the compacts and enables diffusion during sintering to proceed evenly to thereby give homogenous sinters with little component segregation. This kind of sinters have further advantages that since they have a stable Ms point, constant conditions for sizing or coining can be used and the final parts have improved dimensional accuracy.

In the process of the present invention, the iron-based sinter thus obtained is austenized before being sized or coined. It is therefore unnecessary to temporarily cool the sinter to ordinary temperature. That is, the sinter is not cooled, after the sintering step, to or below the martensitic transformation initiation point (Ms point) thereof from the sintering temperature and can be austenized at a temperature not lower than the austenizing temperature (Ae1 point) thereof immediately after sintering, because sintering temperatures are generally higher than Ae1 points. As a result, a higher energy efficiency can be attained.

The austenizing treatment of the iron-based sinter is accomplished by heating the sinter at a temperature not lower than the Ae1 point determined by the composition of the sinter. A heating oven of the common batch or belt type or other device may be used for heating. Dielectric heating, with which accurate heating is possible and which has a high energy efficiency, is preferred because precise control of the actual temperature of the quenched sinter is important during the sizing or coining step.

The austenized sinter is quenched by being cooled at a rate at which martensitic transformation occurs, e.g., at a rate higher than 10° C./sec. The quenched sinter should not be cooled to below its Ms point and should not be maintained at a temperature where bainitic transformation takes place.

When the quenched sinter has been cooled to a temperature in the range of from the Ms point to Ae1 point thereof, dimensional correction is conducted by sizing or coining. The pressure for the sizing or coining is preferably from 2 to 10 t/cm$^2$. Sizing or coining pressures lower than 2 t/cm$^2$ tend to result in insufficient dimensional correction, while pressures higher than 10 t/cm$^2$ may result in a shortened mold life but yield parts having impaired dimensional accuracy due to mold deflection.

The temperature of the mold during sizing or coining is preferably (Ms point +100)° C. or lower. If the temperature of the sizing or coining mold exceeds (Ms point +100)° C., there may be cases where since the temperature of the quenched sinter does not drop to or below the Ms point during sizing or coining, martensitic transformation may occur not during sizing or coining but after the quenched sinter is taken out of the mold, resulting in reduced dimensional accuracy. The reason for the upper limit of the mold temperature which is higher by 100° C. than the Ms point is that the martensitic transformation initiation point can rise due to the deformation processing during sizing or coining.

The present invention will be described in more detail with reference to the following examples, but the present invention should not be construed as being limited thereto.

EXAMPLE 1

A partially diffused alloy powder having a composition consisting of Fe, 4 wt % of Ni, 0.5 of wt % Mo, and 1.5 of wt % Cu was mixed with 0.8 wt % of graphite powder and 0.8 wt % of a lubricant. The mixed powder was compacted at a pressure of 6 t/cm$^2$ into a ring shape having an outer diameter of 40 mm, an inner diameter of 27 mm, and a thickness of 10 mm.

This compact was sintered at 1,150° C. for 20 minutes in a reduced-pressure nitrogen gas atmosphere to obtain an iron-based sinter having a true density ratio of 89% and a porosity of 11%. The F(e) value of this sinter, which value is defined by the following equation was calculated from the composition, and was found to be 368.

$$F(e)=350\times C\ \%+40\times Mn\ \%+35\times V\ \%+20\times Cr\ \%+17\times Ni\ \%+11\times Si\ \%+10\times Cu\ \%+10\times Mo\ \%+5\times W\ \%-15\times Co\ \%-30\times Al\ [\{]ps$$

wherein C %, Mn %, V %, Cr %, Ni %, Si %, Cu %, Mo %, W %, Co %, and Al % represent the amounts of C, Mn, V, Cr, Ni, Si, Cu, Mo, W, Co, and Al respectively, in terms of weight percents. The martensitic transformation point (Ms point) and austenizing temperature (Ae1 point) of a sinter having this composition were measured in a separate test and found to be about 170° C and about 750° C., respectively.

Subsequently, the sinter obtained above was austenized at 880° C., and then placed into an oil tank maintained at 180° C. to perform quenching. At the time when the sinter which was being quenched had cooled to about 260° C. in the oil tank after about 18 seconds, the sinter was taken out of the oil tank and sized at a pressure of 7 t/cm$^2$ using a sizing mold heated at 170° C. to reduce the inner and outer diameters thereof by 50 μm. Thus, dimensional correction was conducted. At the time of the completion of sizing, martensitic transformation in the sized sinter had been completed.

This sized sinter was subjected to subzero cooling at −10° C. for 10 minutes, and the surface hardness and tensile strength thereof after the treatment were 72 in terms of $H_RA$ and 150 kg/mm$^2$, respectively. Fifty sized sinters obtained in the same manner were examined for roundness with respect to each of the inner and outer diameters. As a result, the maximum roundness for the inner diameter was 4 μm and that for the outer diameter was 6 μm.

For the purpose of comparison, two sinters having the same composition were produced and austenized in the same manner. One of the sinters obtained was then maintained in a 300° C. salt bath for 6 minutes to permit the sinter to undergo bainitic transformation, while the other was cooled to 150° C., which was below the Ms point thereof. These sinters were subjected to sizing under the same conditions as the above. As a result, dimensional correction was impossible. Even though these sinters were reheated to 700° C. and then sized or coined at 250° C., almost no plastic deformation was observed.

EXAMPLE 2

A metal powder containing a partially diffused alloy powder as a component thereof and having a composition consisting of Fe, 3.5 wt % of Ni, 0.5 wt % of Mo, 1 wt % of Mn, 1 wt % of Cr, and 0.5 wt % of Si was mixed with 0.6 wt % of graphite powder. The powder mixture was compacted at a pressure of 8 t/cm$^2$ using a mold coated with a lubricant to thereby obtain a rectangular compact having a true density ratio of 91% and dimensions of 10 mm×10 mm×55 mm.

The compact was heated to 1,280° C. by dielectric heating in a reduced-pressure nitrogen gas atmosphere and maintained at that temperature for 3 minutes to conduct sintering. The sinter obtained was austenized immediately thereafter without cooling it to room temperature. At the time when the sinter had cooled to 850° C., it was placed into an oil tank maintained at 150° C. to perform quenching. The F(e) value for the sinter calculated from the composition thereof using the equation given above was 340. The Ms point and Ae1 point of the sinter were measured in a separate test and found to be about 200° C. and about 750° C., respectively.

At the time when the sinter which was being quenched had cooled to about 230° C. in the oil tank after about 15 seconds, the sinter was taken out of the oil tank and coined at a pressure of 8 t/cm$^2$ to a true density ratio of 97% using a coining mold heated at 100° C. At the time of the completion of coining, martensitic transformation in the coined sinter had been completed.

This coined sinter was tempered at 200° C. for 60 minutes. The tempered coined sinter had a surface hardness of 69 in terms of $H_RA$ and a tensile strength of 210 kg/mm$^2$. This coined sinter was examined for the roundness of the locus defined by the four corners of the sinter, which locus corresponded to the true circle defined by the four corners of the cavity of the coining mold. As a result, the roundness was 9 μm.

For the purpose of comparison, an alloy powder having a composition consisting of Fe, 2 wt % of Ni, and 0.5 wt % of Mo was mixed with 0.4 wt % of graphite powder. The powder mixture was compacted to a true density ratio of 90% and the compact was sintered. The sinter obtained had an F(e) value, as calculated from the composition thereof using the equation given above, of 179, an Ms point of about 380° C., and an Ae1 point of about 750° C.

This sinter was austenized and then quenched under the same conditions as the above. At the time when the sinter which was being quenched had cooled to about 400° C. after about 5 seconds, the sinter was coined at a pressure of 8 t/cm$^2$ using a coining mold heated at 180° C. However, the true density ratio of this coined sinter had increased to as low as 92%. This coined sinter was tempered under the same conditions. As a result, the tempered sinter had a surface hardness of about 80 in terms of $H_RA$ and a tensile strength as low as 65 kg/mm$^2$. Further, the roundness of the locus defined by the four corners of the tempered sinter, which locus corresponded to the true circle defined by the four corners of the cavity of the coining mold, was 42 μm, showing that the tempered sinter had extremely poor dimensional accuracy.

EXAMPLE 3

As a heat-treated sintered iron alloy part having a composition consisting of Fe, 4 wt % of Ni, 0.5 wt % of Mo, 1.5 wt % of Cu, and 0.8 wt % of C, outer rotors for a 4-leaf 5-crank oil pump which rotors each had been designed to have an outer diameter of 55 mm and involute teeth, with the inscribed circle for the teeth having a diameter of 38 mm, were produced by the following methods so that the roundness of the inscribed circle became 10 μm.

Outer rotor A was produced by cold-sizing a sinter having the above composition. Outer rotor B was produced by cold-sizing the sinter and quenching the sized sinter, followed by cutting. Outer rotor C was produced by austenizing and quenching the sinter in the same manner as in Example 1 and then sizing the quenched sinter under the same conditions as in Example 1.

Each of these outer rotors were used in combination with inner rotors which differed in the diameter of the circumscribed circle for the teeth. Each oil pump was tested for durability at a constant tip clearance. As a result, outer rotor A deformed and locked at the time when the discharge pressure had reached 61 kg/cm$^2$, so that the revolution of the rotor became impossible. Outer rotors B and C were free from any trouble throughout 1,000-hour operation at a discharge pressure of 90 kg/cm$^2$, but at the time of the completion of the 1,000-hour operation, the efficiency of outer rotor C was higher by about 10%.

After the durability test, the sliding surfaces of outer rotors B and C were examined. As a result, the wear loss of outer rotor C was 5 μm, whereas outer rotor B had a wear loss of 14 μm and had suffered a higher degree of cavitation damage. The sized surface of outer rotor C had been densified, with the amount of exposed pores being as low as about 4%.

According to the present invention, a heat-treated sintered iron alloy part can be provided which has enhanced strength and hardness due to heat treatment and has high dimensional accuracy almost comparable to that of parts produced by sizing, coining, or cutting. The present invention has another advantage that since there is no need for post-processing such as cutting unlike conventional techniques, not only the machining cost can be reduced, but also the processing loss of materials can be reduced to thereby attain an improved yield. Namely, the process of the invention is extremely advantageous in production cost.

The heat-treated sintered iron alloy part obtained by the present invention therefore combines dimensional accuracy, performance, inexpensiveness, etc. at the same time, so that it is usable in place of ordinary machined steel parts. For example, when an oil pump rotor is produced as the heat-treated sintered iron alloy part of the present invention, the dimensional accuracy of the teeth can be improved, so that it becomes possible to obtain an increased discharge rate, improved pump efficiency, and reduced pump noise. Furthermore, since the pores present in the surface layer of the heat-treated sintered iron alloy part of the present invention have been crushed, the part has improved wear resistance and is reduced in cavitation.

While the invention has been described in detail and with reference to specific examples thereof, it will be apparent to one skilled in the art that various changes and modifications can be made therein without departing from the spirit and scope thereof.

What is claimed is:

1. A process for producing a heat-treated sintered iron alloy part, said process comprising:

austenitizing an iron-based sinter having a martensitic transformation initiation point (Ms point) of from 50° to 350° C., at a temperature not lower than the austenitizing temperature (Ae1 point) of the sinter;

quenching said austenitizing sinter at a cooling rate at which martensitic transformation occurs; and sizing or coining said quenched sinter during said quenching at the time when the temperature of said sinter which is being quenched has reached the temperature range of from said Ms point to said Ae1 point, so as to complete martensitic transformation of said sinter.

2. A process for producing a heat-treated sintered iron alloy part as claimed in claim 1, wherein said iron-based sinter is a sinter which, through martensitic transformation, comes to have a tensile strength of 80 kg/mm$^2$or higher and a surface hardness of 60 or higher in terms of $H_RA$.

3. A process for producing a heat-treated sintered iron alloy part as claimed in claim 1, wherein said iron-based sinter has a porosity of from 5 to 20%.

4. A process for producing a heat-treated sintered iron alloy part as claimed in claim 1, wherein said iron-based sinter has a composition consisting of from 0.2 to 1.6 wt % of carbon and the balance of iron.

5. A process for producing a heat-treated sintered iron alloy part as claimed in claim 1, wherein said iron-based sinter has a composition consisting of from 0.2 to 1.6 wt % of carbon, at least 80 wt % of iron, and at least one alloying element selected from Mo in an amount up to 8 wt %, Ni in an amount up to 6 wt %, Mn, Cr, and Cu each in an amount up to 4 wt %, W and Co each in an amount up to 2 wt %, and Si, V, and Al each in an amount up to 1 wt %, with a value F(e) defined by the following equation being from 200 to 500:

$$F(e)=350\times C\%+40\times Mn\%+35\times V\%+20\times Cr\%+17\times Ni\%+11\times Si\%+10\times Cu\%+10\times Mo\%+5\times W\%-15\times Co\%-30\times Al\%$$

wherein C %, Mn %, V %, Cr %, Ni %, Si %, Cu %, Mo %, W %, Co %, and Al % represent the amounts of C, Mn, V, Cr, Ni, Si, Cu, Mo, W, Co, and Al respectively, in terms of weight percents.

6. A process for producing a heat-treated sintered iron alloy part as claimed in claim 1, wherein said iron-based sinter is not cooled to or below said Ms point thereof from the sintering temperature, before being austenitized at a temperature not lower than said Ae1 point.

7. A process for producing a heat-treated sintered iron alloy part as claimed in claim 1, wherein said sizing or coining is conducted at a pressure of from 2 to 10 t/cm$^2$.

8. A process for producing a heat-treated sintered iron alloy part as claimed in claim 1, wherein said sizing or coining is conducted using a mold heated at (Ms point +100)°C. or lower.

* * * * *